US006406012B1

(12) United States Patent
Guo

(10) Patent No.: US 6,406,012 B1
(45) Date of Patent: Jun. 18, 2002

(54) VISE STRUCTURE

(76) Inventor: Shuenn-Jyi Guo, No. 53, Shue Jong-Jeng St., Shin-Sheh Hsiang, Taichung Hsien (TW)

( * ) Notice: Subject to any disclaimer, the term of this patent is extended or adjusted under 35 U.S.C. 154(b) by 0 days.

(21) Appl. No.: 09/848,438

(22) Filed: May 4, 2001

(51) Int. Cl.[7] ..... B25B 1/02

(52) U.S. Cl. ..... 269/212; 269/194; 269/215; 269/171

(58) Field of Search ..... 269/215, 212, 269/207, 193–194, 203, 159, 165, 171, 137

(56) References Cited

U.S. PATENT DOCUMENTS 2,815,053 A * 12/1957 Walker ..... 269/212
2,930,293 A * 3/1960 Muench ..... 269/212
4,138,100 A * 2/1979 Krummenacher ..... 269/137
4,327,903 A * 5/1982 Kawasaki ..... 269/212

* cited by examiner

*Primary Examiner*—Joseph J. Hail, III
*Assistant Examiner*—Lee Wilson
(74) *Attorney, Agent, or Firm*—Troxell Law Office PLLC

(57) ABSTRACT

A vise includes a base having a fixed clamp member and a rack member is connected to the base. A movable clamp member is movably connected to the base and a rod extends through a horizontal portion of the movable clamp member. A connection member is mounted to the rod and has two lugs between which a pushing member is pivotally connected. A position member is pivotally connected to the connection member and a second end of the position member is engaged with of the rack member. A head is connected to the rod and located between the two lugs. The head has an inclined surface and an underside of the pushing member is rested on the inclined surface. A pushing surface is defined in an end of the pushing member and is matched with a vertical portion of the movable clamp member. The pushing member prevents the top portion of the movable clamp member from being deformed.

7 Claims, 8 Drawing Sheets

VISE STRUCTURE

FIELD OF THE INVENTION

The present invention relates to a vise and the movable clamp member has a pushing member urging a force on a back so as to clamp the object firmly.

BACKGROUND OF THE INVENTION

A conventional vise for clamping an object between a fixed clamp member 3 and a movable clamp member 2 is shown in FIG. 1 and generally includes a base 1 and the fixed clamp member 3 extends upward from the base 1 and the movable clamp member 2 is movably connected on the base 1. A threaded rod 4 extends through a frame 5 on the base 1 and is connected to the back of the movable clamp member 2. The movable clamp member 2 is moved toward the fixed clamp member 3 by rotating the threaded rod 4 so as to clamp objects between the fixed clamp member 3 and the movable clamp member 2. It is experienced that because the fixed clamp member is connected to the base 1 at its lower end, so that a top portion 3*a* of the fixed clamp member could be deformed slightly when a force is applied to the top portion 3*a* of the fixed clamp member 3. A similar situation is happened on the top portion 2*a* of the movable clamp member 2. Therefore, when the objects clamped by the movable clamp member 2 and the fixed clamp member 3 are tubular objects, the top most object could not be clamped firmly and when a force is applied on the objects, the top most one could jump out from the vise.

SUMMARY OF THE INVENTION

In accordance with one aspect of the present invention, there is provided a vise and comprises a base having a fixed clamp member and a movable clamp member. A rack member is connected to the base and a rod has a first end thereof extending through a horizontal portion of the movable clamp member and is connected to a fixing member from an underside of the base. A connection member is mounted to the rod and has two lugs extending therefrom. A position member has a first end thereof pivotally connected to the connection member and a second end of the position member is engaged with the rack member. A head is connected to a second end of the rod and located between the two lugs. The head has an inclined surface. A pushing member is pivotally connected between the two lugs and an underside of a first end of the pushing member is rested on the inclined surface of the head. A pushing surface is defined in a second end of the pushing member and matched with a vertical portion of the movable clamp member.

The primary object of the present invention is to provide a vise that the movable clamp member has a deformation compensation device which prevents the top portion of the movable clamp member from being deformed.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
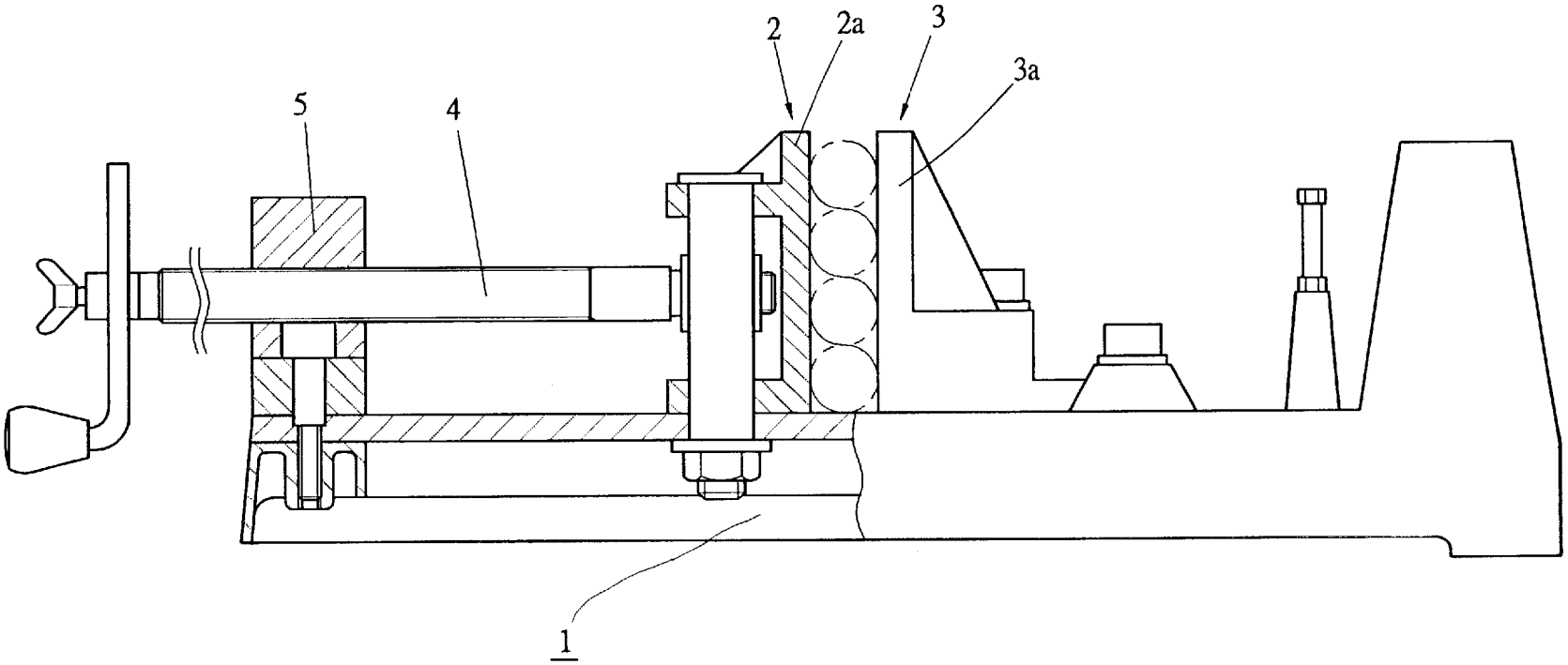
Fig.1 Prior Art
FIG. 1 is a cross sectional view to show a conventional vise.
Figure 2:
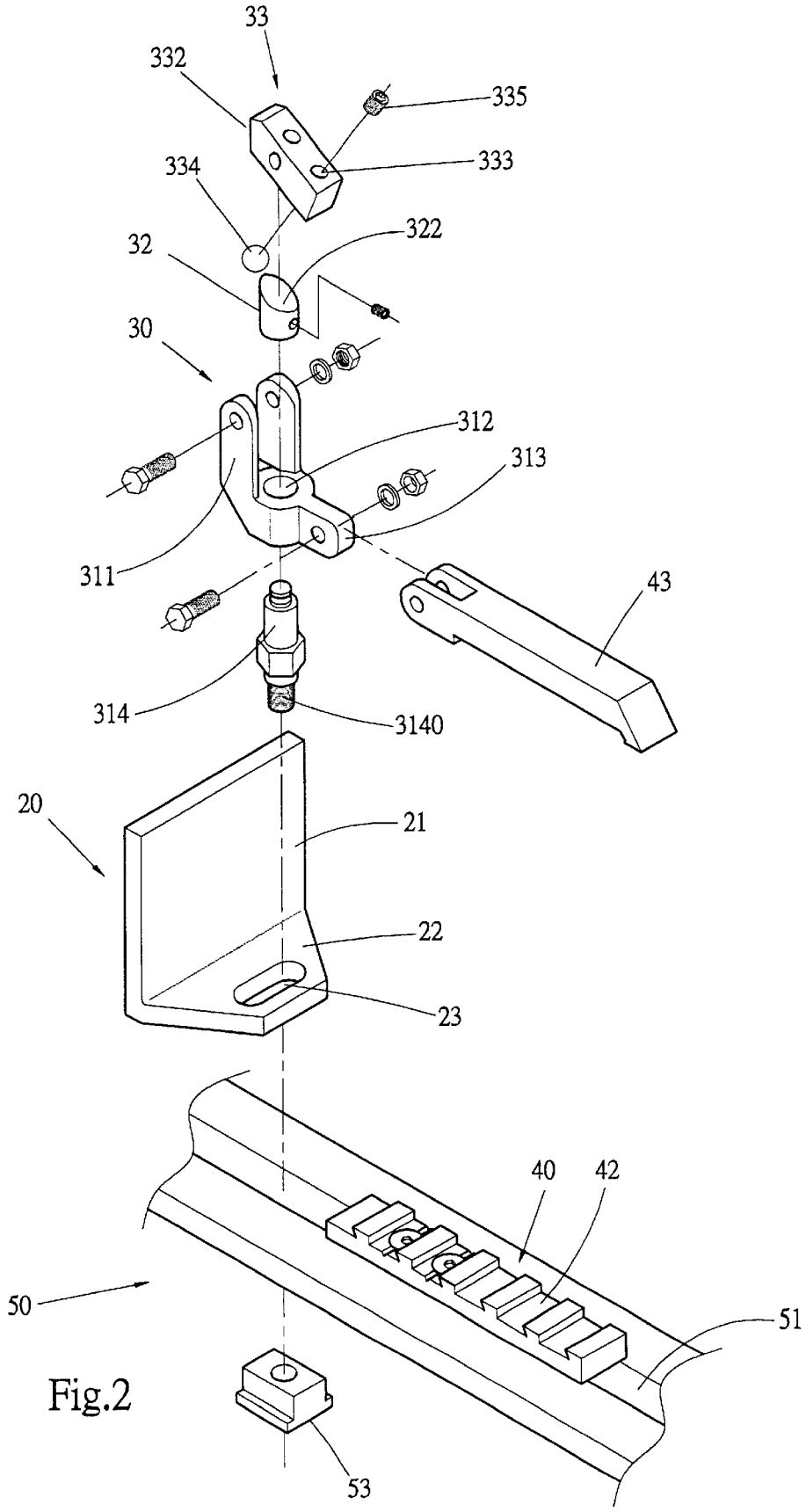
FIG. 2 is an exploded view to show a vise of the present invention.
Figure 3:
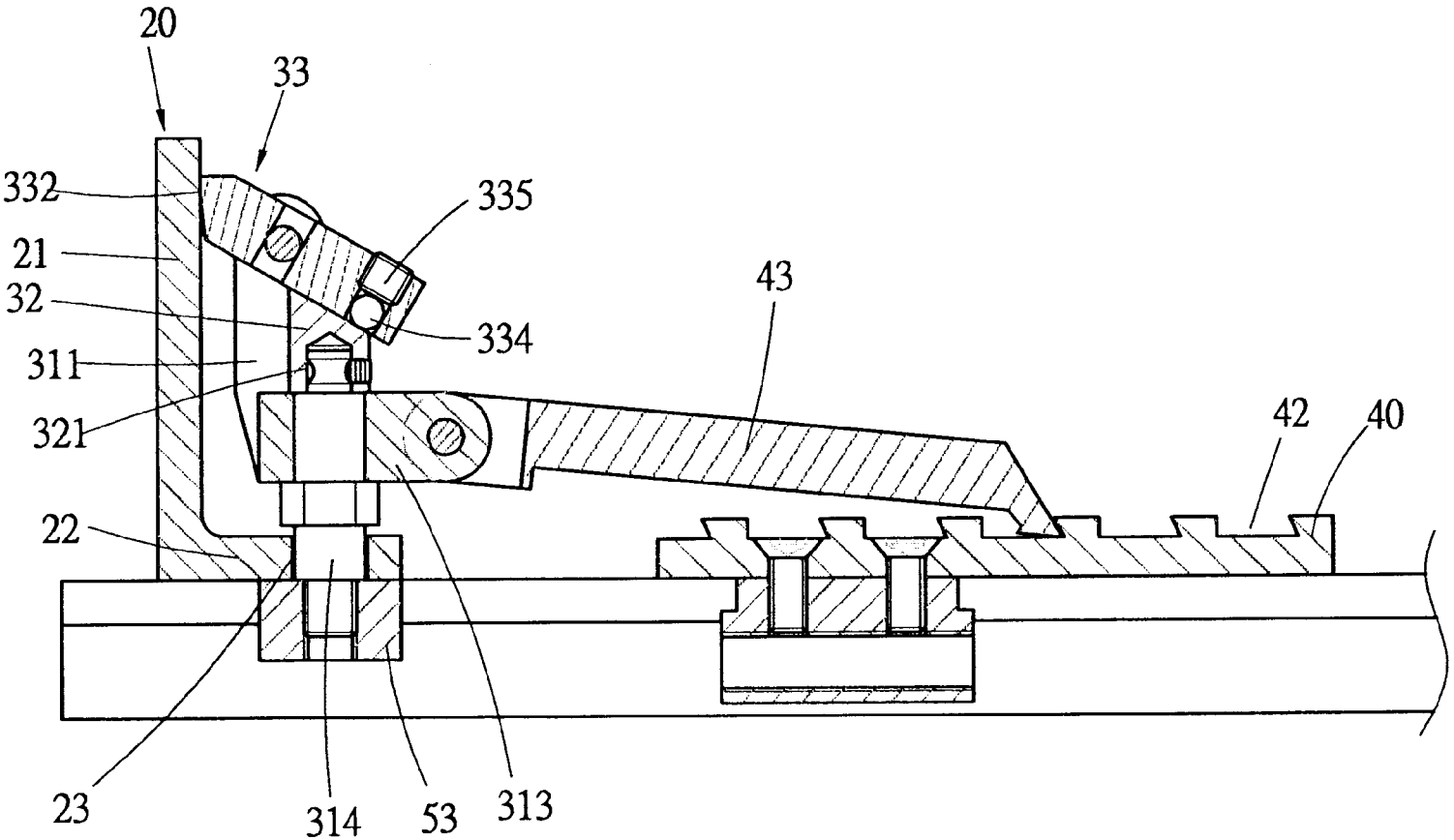
FIG. 3 is a cross sectional view to show the movable clamp member is pushed by a position member.
Figure 4:
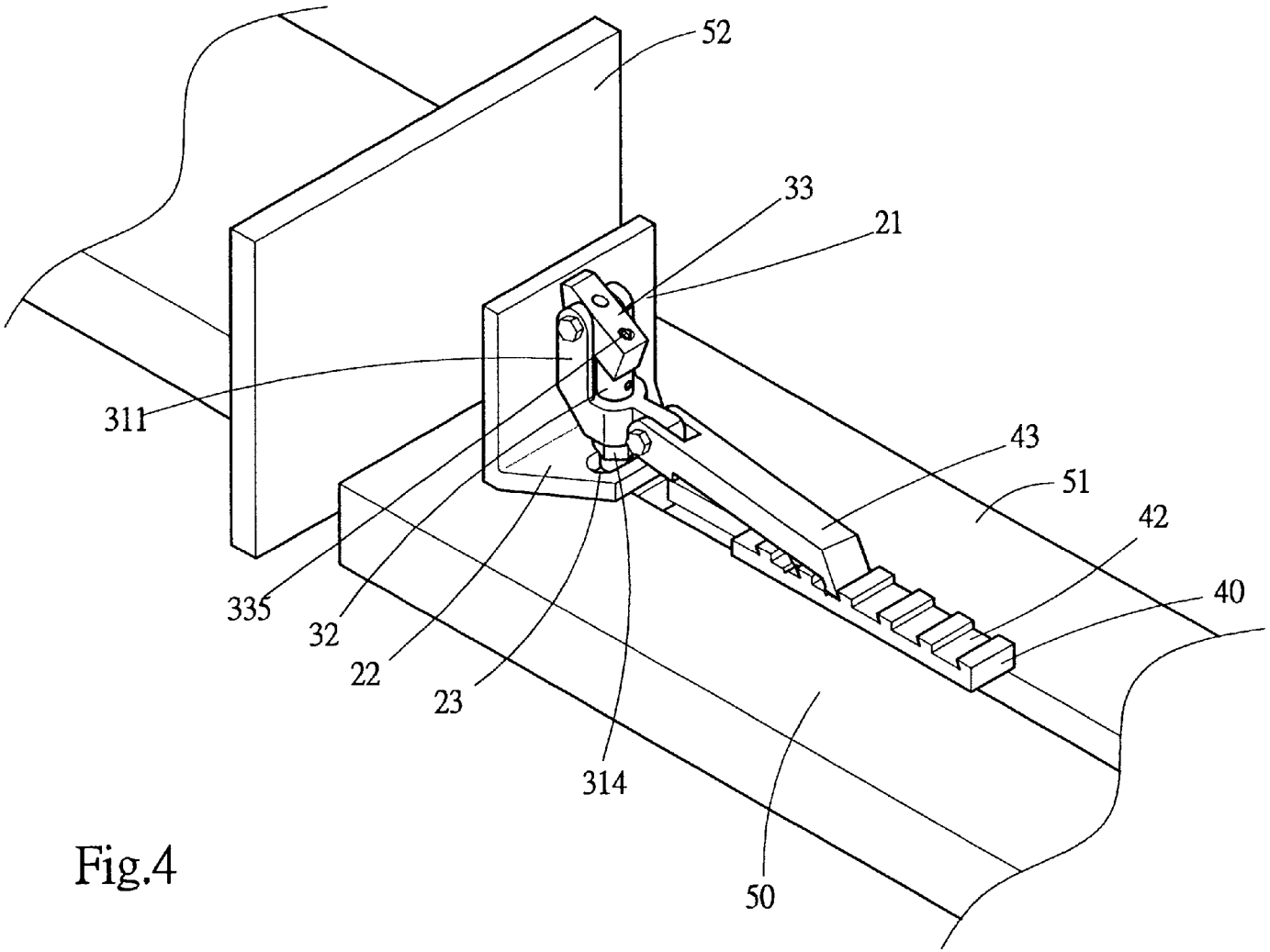
FIG. 4 is a perspective view to show the vise of the present invention.

Referring to FIGS. 2 to 4, the vise of the present invention comprises a base 50 having a fixed clamp member 52 extending therefrom and a groove 51 is defined in the base 50 so that a rack member 40 is engaged with the groove 51. A plurality of notches 42 are defined in the rack member 40. A movable clamp member 20 is movably connected to the base 50 and includes a horizontal portion 22 and a vertical portion 21, wherein a slot 23 is defined through the horizontal portion 22. A rod 314 has a first end has a threaded section 3140 extending through the slot 23 in the horizontal portion 22 of the movable clamp member 20 and is threadedly engaged with a fixing member 53 which is located at an underside of the base 50 and connects the movable clamp member 20 to the base 50. A connection member 30 has a hole 312 defined therethrough and the rod 314 is inserted through the hole 312. Two lugs 311 extend from a top of the connection member 30 and a tongue 313 extends radially from the connection member 30. A position member 43 has a first end thereof pivotally connected to the connection member 30 and a second end of the position member 43 is engaged with one of the notches 42 of the rack member 40. By this way, the movable clamp member 20 is pushed toward the fixed clamp member 52. A head 32 has a recess 321 defined in an underside thereof and a second end of the rod 314 is engaged with the recess 321. The head 32 is located between the two lugs 311 and has an inclined surface 322.

A pushing member 33 is pivotally connected between the two lugs 311 and an underside of a first end of the pushing member 33 is rested on the inclined surface 322 of the head 32. A pushing surface 332 is defined in a second end of the pushing member 33 and is matched with a vertical portion 21 of the movable clamp member 20. The position that the pushing surface 332 contacts the movable clamp member 20 is close to a top edge of the vertical portion 21 of the movable clamp member 20. The pushing member 33 has a passage 333 defined therethrough and a ball 334 is retained in the passage 333, a bolt 335 threaded engaged with the passage 333 and urged the ball 334. By moving the bolt 335, the position of the ball 334 is adjusted and the force applied to the vertical portion 21 of the movable clamp member 20 can be adjusted.

Figure 5:
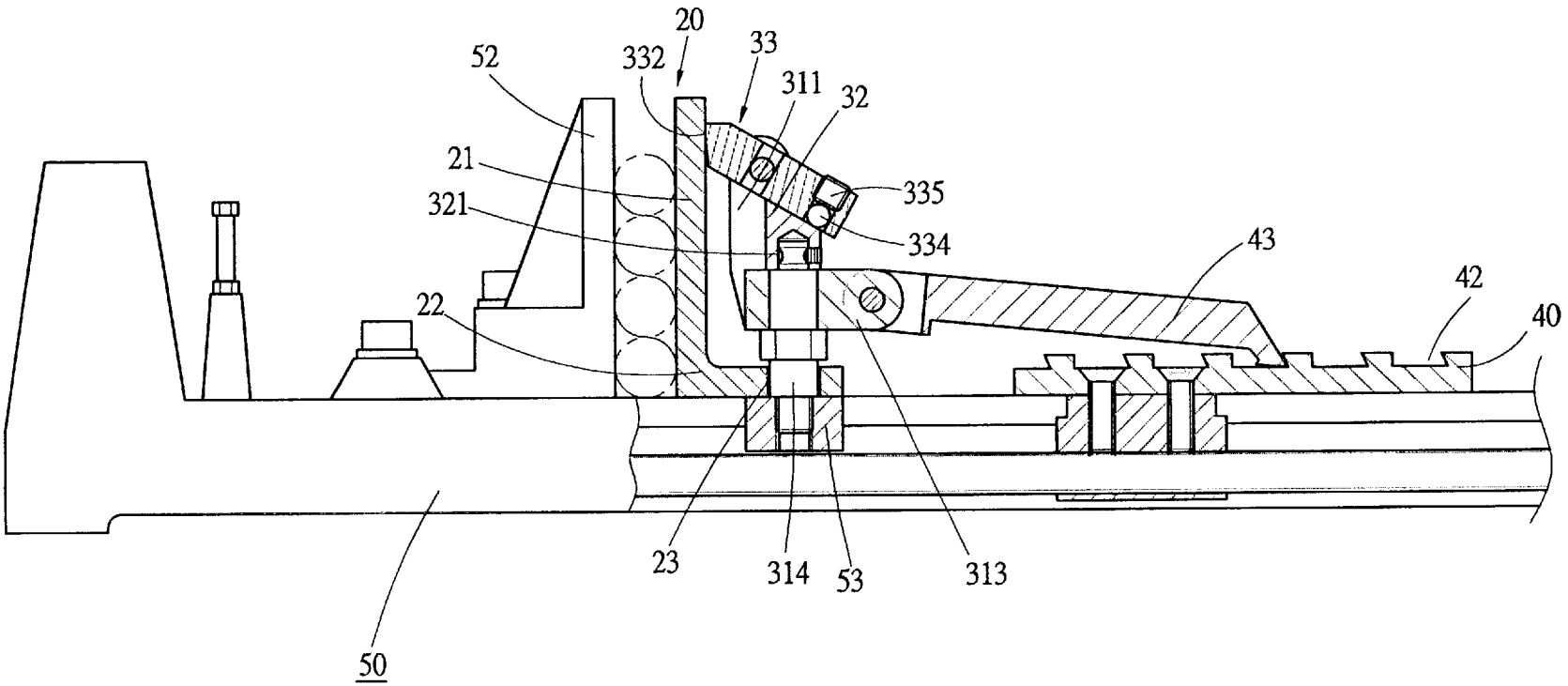
FIG. 5 is a cross sectional view to show four tubular objects are clamped between the fixed and movable clamp member of the vise of the present invention.
Figure 6:
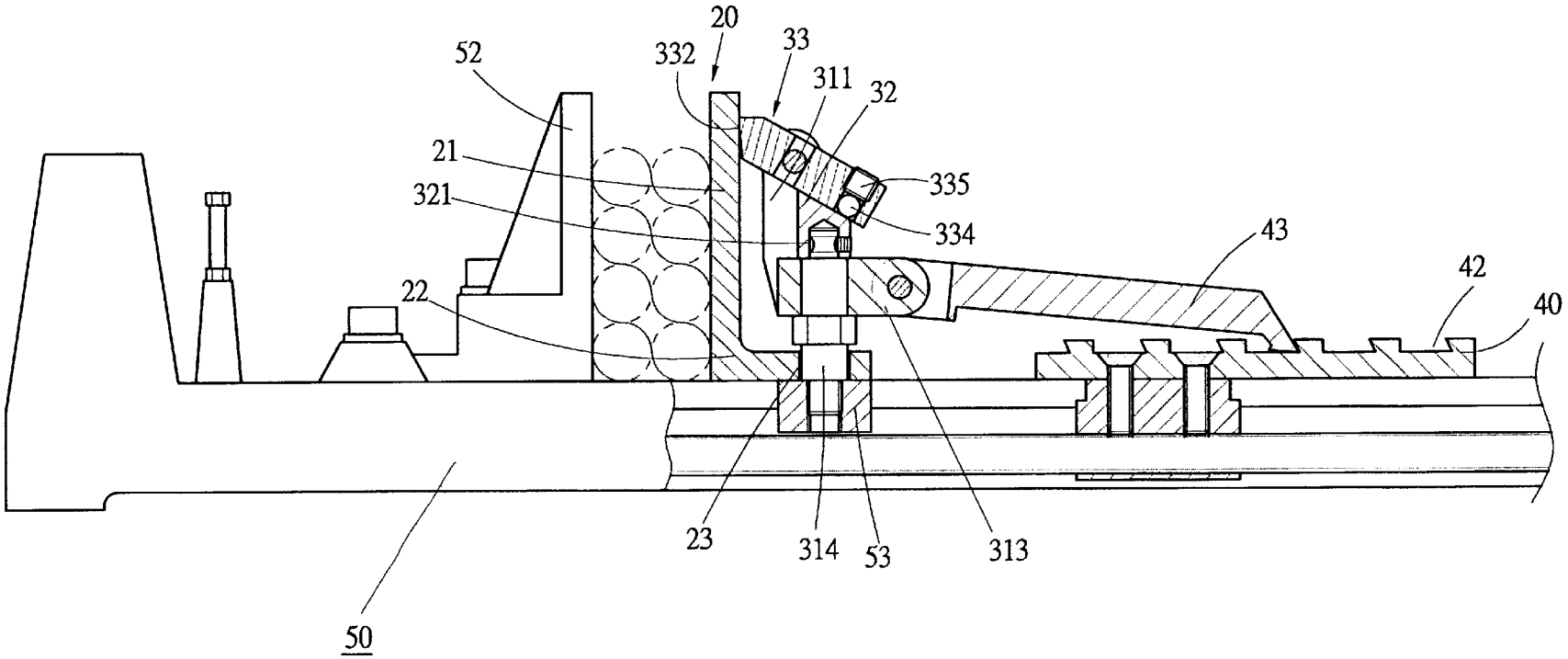
FIG. 6 is a cross sectional view to show eight tubular objects are clamped between the fixed and movable clamp member of the vise of the present invention.

As shown in FIG. 5, four tubular objects are clamped between the movable clamp member 20 and the fixed clamp member 52, wherein the movable clamp member 20 is firmly supported by the position member 43, and the top portion of the movable clamp member 20 is pushed by the pushing member 33 so that even the upper most object is clamped by the movable clamp member 20 and the fixed clamp member 52. In other words, the potential deformation of the top portion of the movable clamp member 20 can be controlled by the pushing member 33. The vise of the present invention may conveniently clamp eight tubular objects as shown in FIG. 6, and because the top portion of the movable clamp member 20 is pushed by the pushing member 33, so that the eight tubular objects can also firmly clamped.

Figure 7:
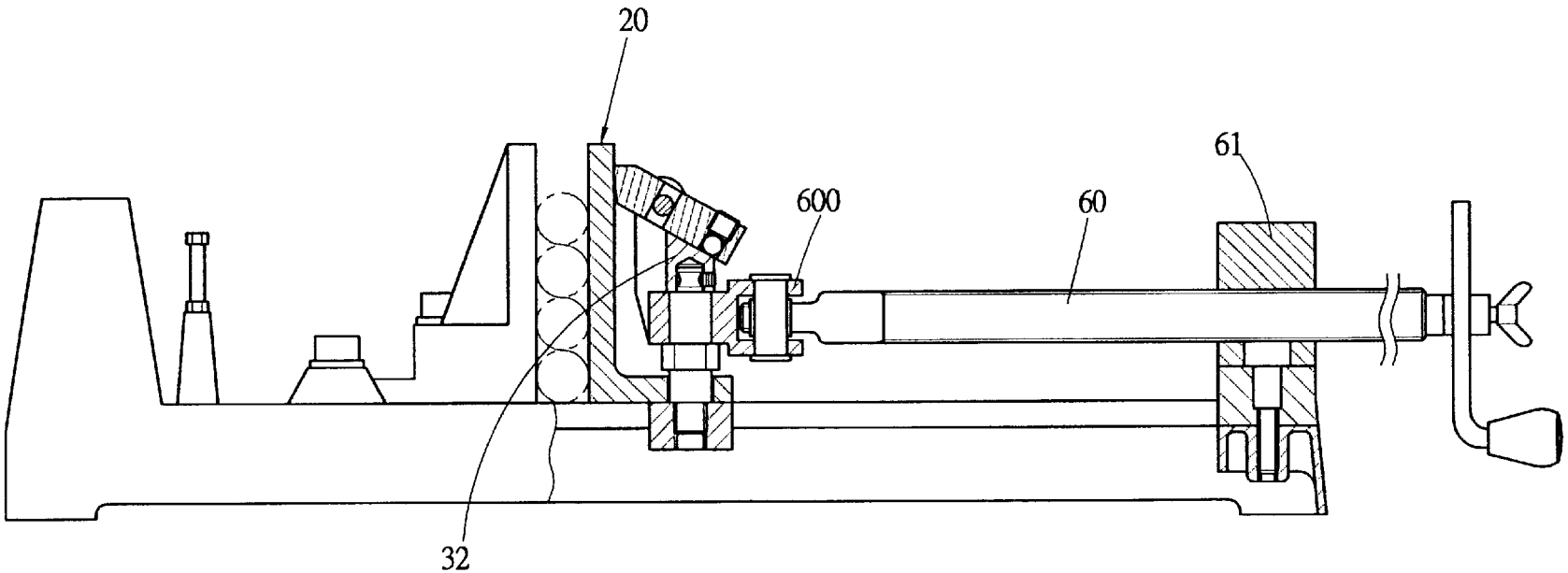
FIG. 7 is a cross sectional view to show another embodiment of the vise of the present invention, wherein four tubular objects are clamped between the fixed and movable clamp member.
Figure 8:
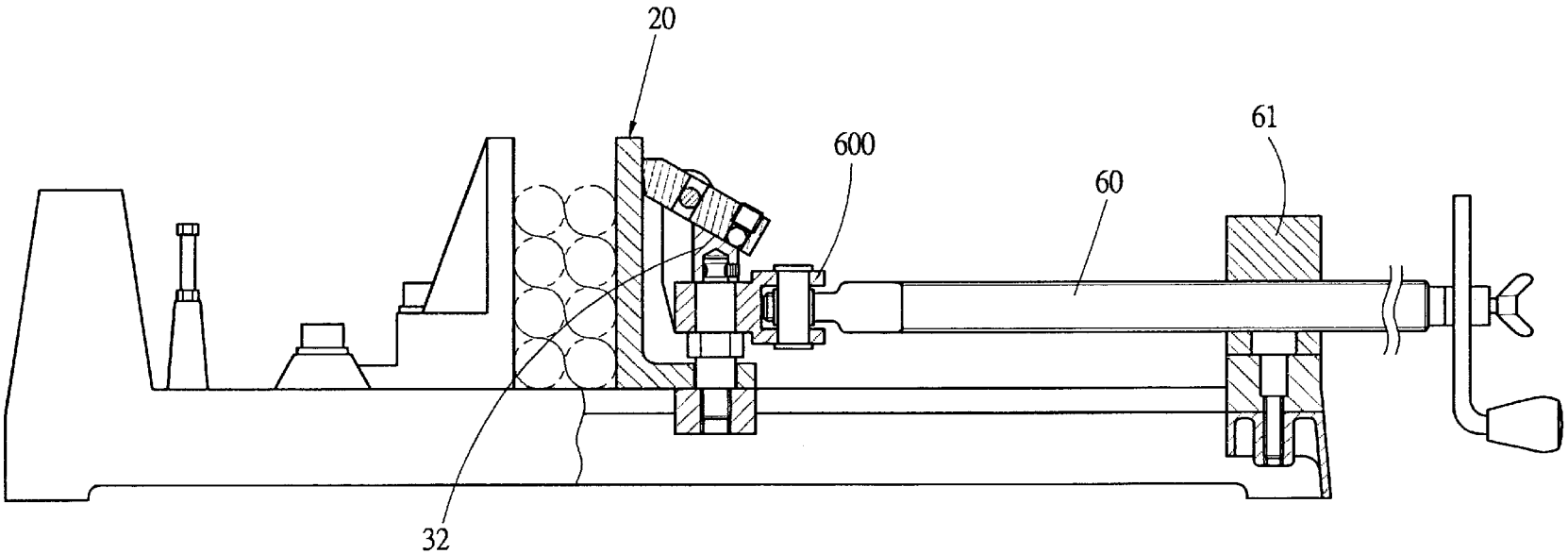
FIG. 8 shows that eight tubular objects are clamped between the fixed and movable clamp member of the vise of the present invention.

FIG. 7 shows that the vise may employ a conventional threaded rod 60 to push the connection member 32. The threaded rod 60 has a first end pivotally connected to a couple member 600 which is connected to the connection member 30 and a second end of the threaded rod 60 threadedly extends through a frame 61 on the base 50. The movable clamp member 20 is moved by rotating the threaded rod 60. FIG. 8 shows that the vise of the present invention may conveniently clamp eight tubular objects.

While we have shown and described the embodiment in accordance with the present invention, it should be clear to those skilled in the art that further embodiments may be made without departing from the scope of the present invention.

What is claimed is:

1. A vise comprising:

a base having a fixed clamp member extending therefrom and a rack member connected to said base, a plurality of notches defined in said rack member, a movable clamp member movably connected to said base and a rod having a first end thereof extending through a horizontal portion of said movable clamp member and connected to said base;

a connection member mounted to said rod and having two lugs extending therefrom, a position member having a first end thereof pivotally connected to said connection member and a second end of said position member engaged with one of said notches, a head connected to a second end of said rod and located between said two lugs, said head having an inclined surface, and a pushing member pivotally connected between said two lugs and an underside of a first end of said pushing member rested on said inclined surface of said head, a pushing surface defined in a second end of said pushing member and matched with a vertical portion of said movable clamp member.

2. The vise as claimed in claim 1, wherein a groove is defined in said base and said rack member is engaged with said groove, said first end of said rod having a threaded section which extends through said horizontal portion of said movable clamp member and is threadedly engaged with a fixing member.

3. The vise as claimed in claim 1, wherein said pushing member has a passage defined therethrough and a ball is retained in said passage, a bolt threaded engaged with said passage and urged said ball.

4. The vise as claimed in claim 1 wherein said head has a recess defined in an underside thereof and said second end of said rod is engaged with said recess of said head.

5. A vise comprising:

a base having a fixed clamp member extending therefrom and a movable clamp member movably connected to said base, a rod having a first end thereof extending through a horizontal portion of said movable clamp member and engaged with a fixing member which is located at an underside of said base;

a connection member mounted to said rod and having two lugs extending therefrom, a threaded rod having a first end thereof pivotally connected to said connection member and a second end of said threaded rod threadedly extending through a frame on said base, a head connected to a second end of said rod and located between said two lugs, said head having an inclined surface, and a pushing member pivotally connected between said two lugs and an underside of a first end of said pushing member rested on said inclined surface of said head, a pushing surface defined in a second end of said pushing member and matched with a vertical portion of said movable clamp member.

6. The vise as claimed in claim 5, wherein said pushing member has a passage defined therethrough and a ball is retained in said passage, a bolt threaded engaged with said passage and urged said ball.

7. The vise as claimed in claim 5 wherein said head has a recess defined in an underside thereof and said second end of said rod is engaged with said recess of said head.

* * * * *